US005865679A

United States Patent [19]

Seabolt et al.

[11] Patent Number: 5,865,679

[45] Date of Patent: Feb. 2, 1999

[54] WATER SLIDE AND SPRAYER

[76] Inventors: Robert M. Seabolt, 3429 Balfour, Troy, Mich. 48084; Walter M. Griffin, III, 1152 Buckingham, Birmingham, Mich. 48009

[21] Appl. No.: 846,858

[22] Filed: May 1, 1997

[51] Int. Cl.[6] ..... A63G 21/18

[52] U.S. Cl. ..... 472/117

[58] Field of Search ..... 472/117, 128; 239/558, 559

[56] References Cited

U.S. PATENT DOCUMENTS

| | | | |
|---|---|---|---|
| 2,446,905 | 11/1948 | Buffum | 472/117 |
| 3,246,892 | 4/1966 | Grudoski | 472/117 |
| 3,539,181 | 11/1970 | Larsen | 472/117 |
| 4,961,535 | 10/1990 | Skibik | 239/289 |
| 5,027,455 | 7/1991 | Commisso et al. | 5/421 |
| 5,387,158 | 2/1995 | Bertrand | 472/117 |
| 5,427,574 | 6/1995 | Donnelly-Weide | 472/116 |
| 5,478,281 | 12/1995 | Forton | 472/117 |

*Primary Examiner*—Kien T. Nguyen
*Attorney, Agent, or Firm*—Fildes & Outland, P.C.

[57] ABSTRACT

A water sprayer is combined with a play slide to form a water slide for amusement. The sprayer includes a straight tubular portion mounted to an upper end of the slide and having multiple groups of spray openings. Openings in a first group are aligned with an upper end of a slide surface to spray water thereon and openings in a second group are spaced or angled above the first group to spray water onto the users of the slide. A supply portion, extending normal with the straight portion and parallel with the first group of openings, includes a flow control and shutoff valve which is mounted to a side of the slide to align the first group of spray openings with the slide surface. Corrosion free pressure resistant plastic material, garden hose attachment and clamp mounting accommodating thermal expansion are among other features of the sprayer and its combination with a slide.

16 Claims, 4 Drawing Sheets

WATER SLIDE AND SPRAYER

FIELD OF THE INVENTION

This invention relates to water slides and sprayers therefor and more particularly to a water sprayer attachable to a playground or swimming pool slide to spray water on the slide surface.

BACKGROUND OF THE INVENTION

It is known in the art to provide spraying devices for attachment to playground or swimming pool slides and the like in order to lubricate the sloping surface of the slide and increase the enjoyment of the children or other users of the slide. Some of these devices involve tubular distribution manifolds mounted near the upper end of the slide surface and include a plurality of individual spray openings or nozzles spaced longitudinally along a straight portion of the manifold. In general, these openings are confined to a single row or group of openings all aimed in the same general direction to distribute water to the sloping surface of the slide on which a user will slide downward aided by the cooling and lubricating effect of the water. Various means of mounting and connecting these prior devices are known.

SUMMARY OF THE INVENTION

The present invention provides an improved water slide sprayer having various features. Such features may include multiple groups of spray openings providing multiple spray patterns for the distributed water flow, an integrated shutoff and flow control valve, a corrosion free tubular body mountable with little or no ridge where appropriate slide construction is provided, a connectable garden hose fitting, and easy mounting means for commercial slide structures providing freedom for thermal expansion.

These and other features and advantages of the invention will be more fully understood from the following description of certain exemplary embodiments of the invention taken together with the accompanying drawings.

DETAILED DESCRIPTION OF THE INVENTION

Figures 1, 5:
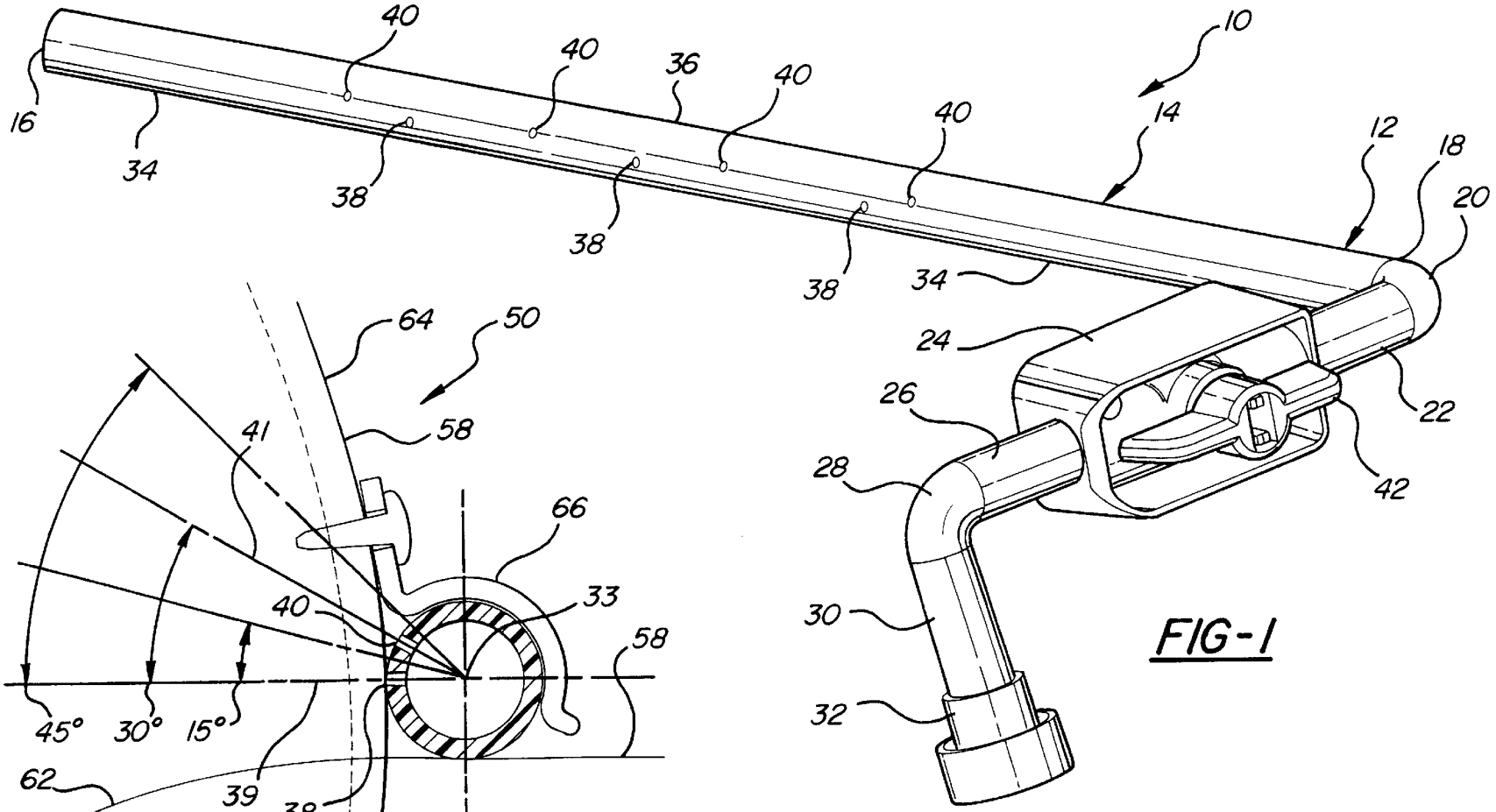
FIG. 1 is an isometric view of a preferred embodiment of water sprayer assembly formed accordance with the invention.
FIG. 5 is a cross-sectional view transverse to the spray manifold and illustrating its mounting and spray openings.

Referring now to the drawings in detail, numeral 10 generally indicates a preferred embodiment of water sprayer assembly formed in accordance with the invention. Sprayer 10, as shown in FIG. 1, includes a water distribution manifold or spray manifold 12 including a straight tubular portion 14 having a closed end 16 and an opposite open end 18. The open end connects through a 90° elbow 20 and tubular connector 22 with a ball-type valve 24. The valve in turn connects through a straight connector 26, 90° elbow 28 and short connector 30 with a fitting 32 adapted for connection with a conventional garden hose.

The straight portion 14 of the spray manifold is tubular with a central longitudinal axis 33 (FIG. 5). Portion 14 includes opposite end portions 34, which are unperforated and adapted for mounting of the manifold to an associated slide, and a central distribution portion 36. The distribution portion is provided with multiple spray openings 38, 40 arranged in at least two separate groups.

In the embodiment illustrated, openings 38 represent a first group and comprise three openings, or nozzles, 38 longitudinally spaced and aligned along the central distribution portion 36 of the manifold. The openings 38 pass radially through the tubular wall on individual axes 39. The axes 39 define a common first plane and extend from the central axis 33 in a direction generally parallel with the connectors 22, 26 and valve 24, also lying in the first plane. The connectors 22, 26 and valve 24 form a right angle with the manifold straight portion 14. The openings 38 thus form a first line of openings aimed along the first plane to spray water in a first direction along their axes 39 and generally parallel with the connectors 22, 26 and valve 24.

Openings 40, comprise a second group of four openings spaced and aligned longitudinally along the central distribution portion 36 of the manifold and forming a second line of openings 40 slightly above the first line of openings 38. The openings 40 also pass radially through the tubular wall on individual axes 41 defining a common second plane. Axes 41 extend from the central axis 33 of the tubular manifold in a direction angled upwardly from the direction of the line of openings 38. Thus, the openings 40 are aimed along the second plane to spray water in a direction above the direction of the line of openings 38.

The angle between the lines of openings and their associated planes may be selected as desired and is shown in FIG. 5 of the drawings as 30 degrees. For example, an angle of between 15 and 45 degrees may be suitable but a range of 15 to 30 degrees is presently preferred. Alternatively, other arrangements of openings and variations in the numbers of openings may be selected as desired. For example, the openings could include three or more groups arranged in separate longitudinally spaced lines of openings or could be arranged in one line with the openings themselves having different aiming orientations. Other patterns are also possible within the scope of the invention so as to provide desired variations in water flow.

Figure 3:
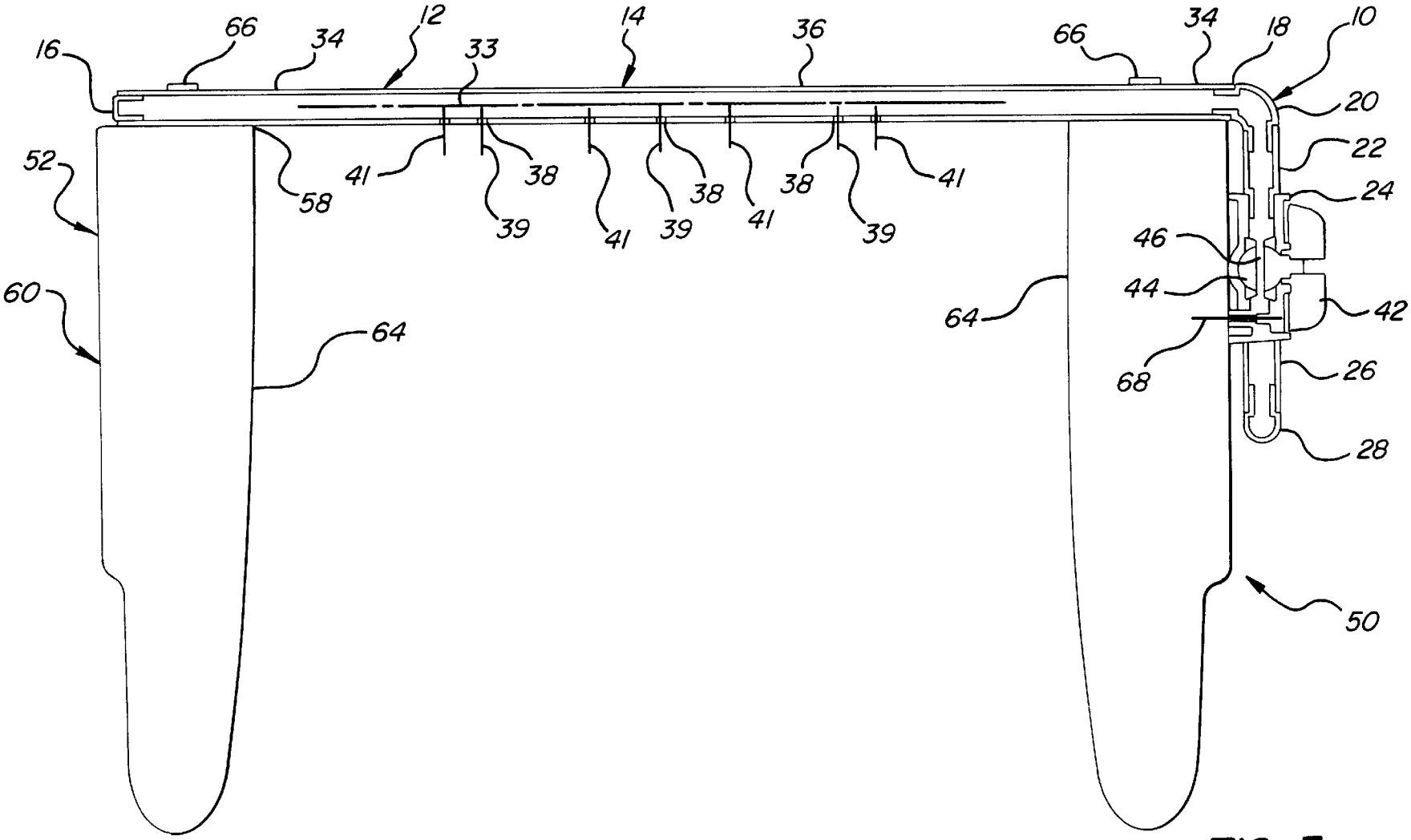
FIG. 3 is a horizontal cross-sectional view through the slide and sprayer assembly of FIG. 2, illustrating the construction and mounting of the sprayer.

The ball valve 24, as is best seen in FIG. 3, includes a handle 42 actuating a shutoff ball 44 having a central opening or orifice 46. The orifice 46 is preferably of a reduced diameter such as 3.5 millimeters, as compared to 12.7 millimeters in similarly sized conventional valves. This reduced size orifice acts to limit the water flow delivered to the distribution manifold to an amount adequate for the purposes of enhancing play on the slide while avoiding excessive water flow.

In order to provide a corrosion free and long lasting assembly, the water sprayer assembly 10 is preferably made of a high strength plastic material such as glass filled polyvinyl chloride (PVC). Other suitable materials may be used as desired.

Figure 2:
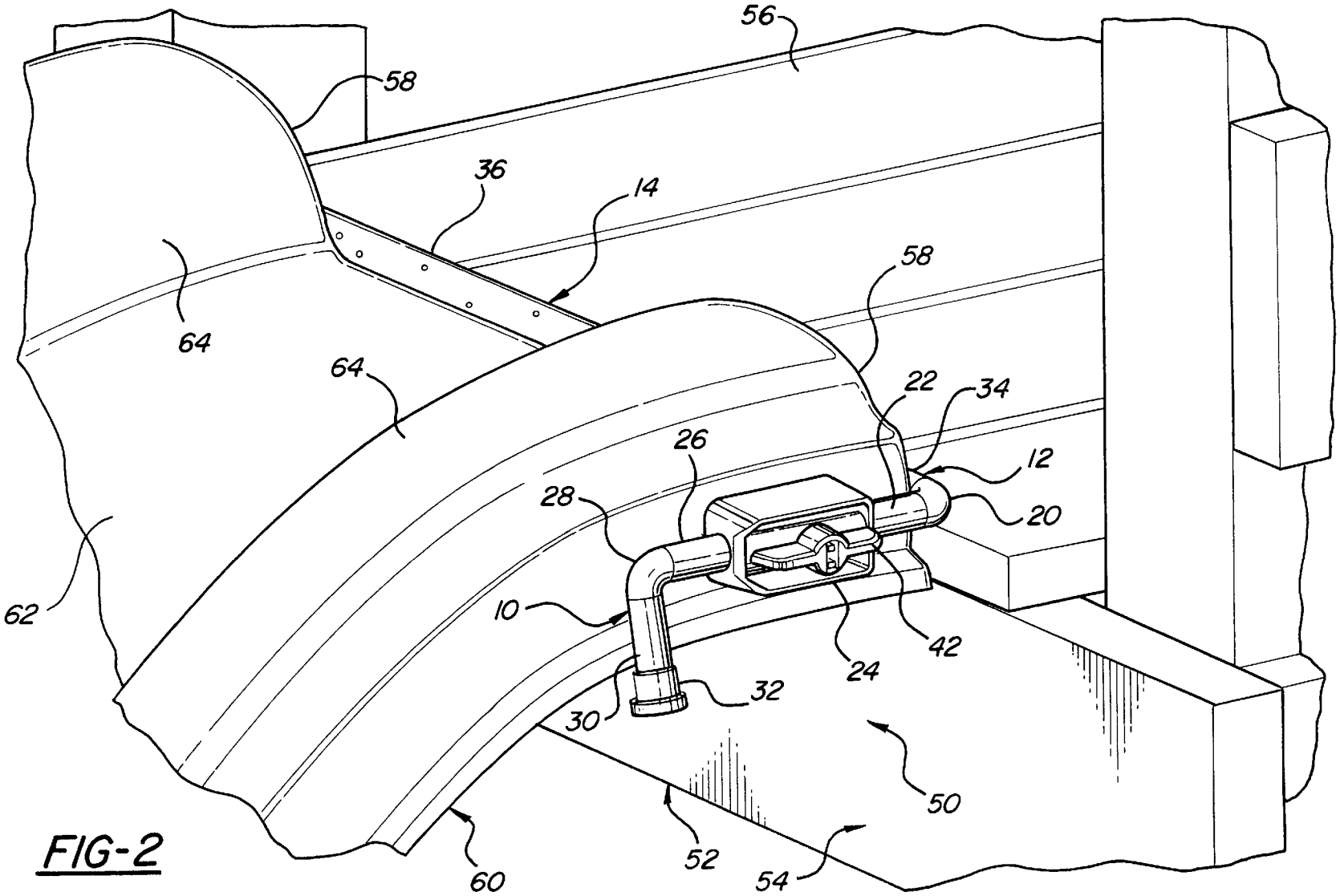
FIG. 2 is a isometric view showing the water sprayer assembly of FIG. 1 mounted to the upper end of a play slide.
Figure 4:
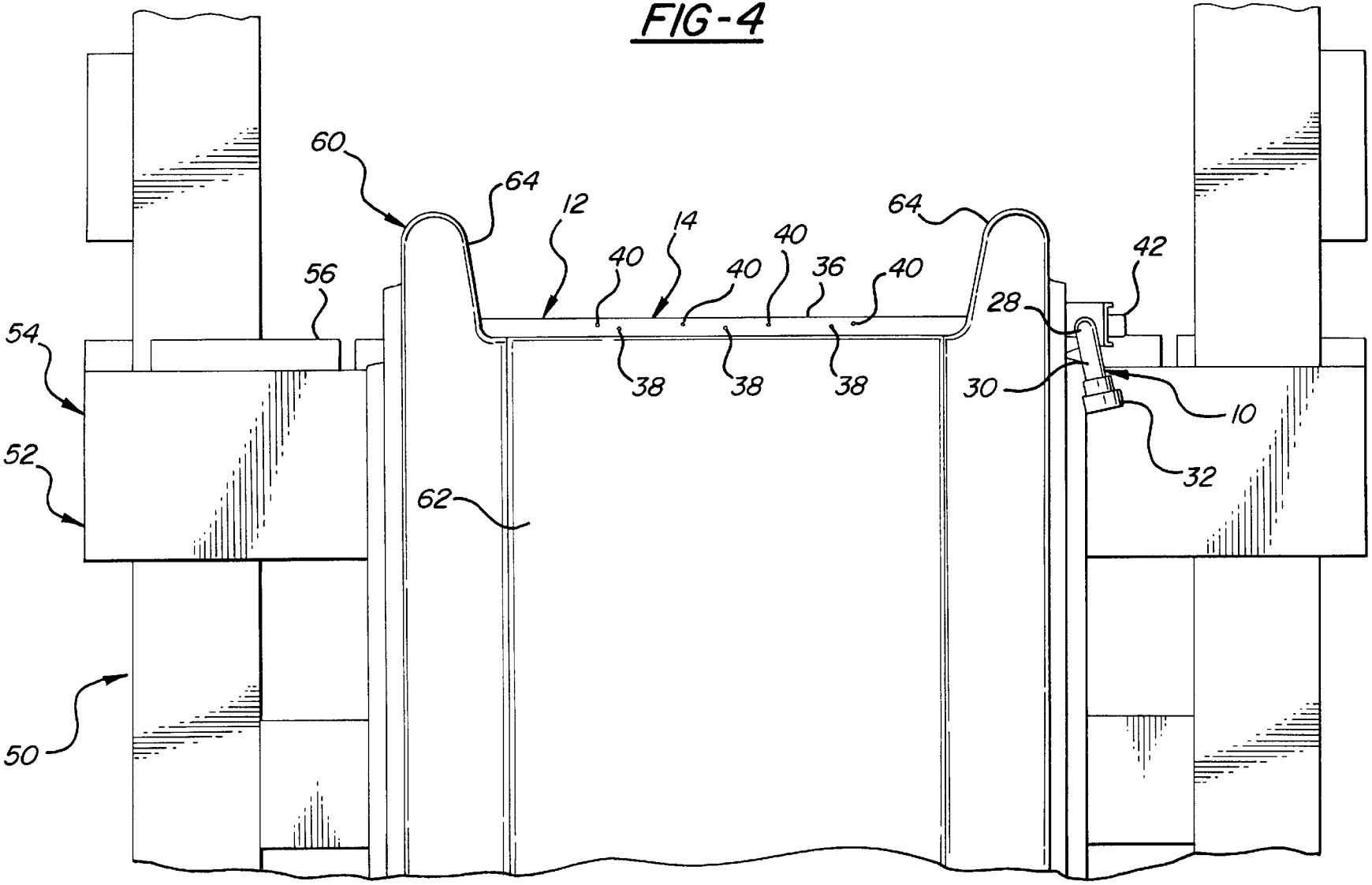
FIG. 4 is a front elevational view of the assembly of FIG. 2 showing the relation of the water sprayer and its spray openings to the slide surface.

FIGS. 2–4 illustrate a water slide assembly 50 comprising one form of conventional playground slide 52 to which a water sprayer assembly 10 has been mounted. Slide 52 includes a wooden or plastic platform 54 including a floor 56 and supporting an upper end 58 of a molded plastic slide 60. Slide 60 includes a variably sloping slide surface 62 bordered by a pair of spaced raised sides 64 adapted to contain a child or other user sliding down the sloping surface 62.

The sprayer assembly 10 is mounted to the slide 60 by a pair of clamps 66 secured to the upper ends 58 of the sides 64 and by screws 68 extending through the body of valve 24 into an outer wall portion of one of the sides 64. The straight portion 14 of the manifold is positioned so that the line of openings 38 is located at the end of the slide surface 62 with the openings 38 aimed generally parallel with the upper end of the slide surface 62 so that water flow from these openings 38 sprays directly upon or above the surface. To accomplish this, the connectors 22, 26, and valve 24 are positioned on a side 64 of the slide so that the direction of the connectors 22, 26 is parallel with and in general alignment with upper end of the slide surface. This automatically aligns the holes 38 with the slide surface. Connector 30 is preferably of a length sufficient to extend below the associated side 64 so that easy connection to a garden hose may be made.

With the first group of holes 38 aligned with the upper end of the slide surface 62, the holes 40 of the second group are positioned to spray water into the air above the slide surface at a suitable angle, such as 15–30 degrees above the surface. This results in added enjoyment for the children or other users since water is not only sprayed upon the surface of the slide to lubricate the surface for better sliding, but is also sprayed against the bodies of the users as they traverse the slide surface, providing additional cooling and enjoyment.

Since the change in temperature which occurs when the water sprayer manifold is in use normally constitutes a considerable departure from the condition when the sprayer is not in use, the arrangement of the supporting clamps 66 in longitudinal alignment allows slippage of the tubular portion 14 of the manifold within the clamps so as to accommodate thermal expansion and contraction of the manifold relative to the slide portions to which it is attached. If the construction of the associated slide permits, the manifold straight portion 14 may be located at the front of the floor portion 56 of the platform so that there is little or no intrusion of the manifold above the level of the platform. This is desirable to avoid a ridge in the sliding surfaces. The valve 24 provides controlled water flow with a non-leak shutoff at the slide which, together with a suitable hose washer at the hose connection 34, provides a non-leak system that is corrosion free and pressure resistant.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A water sprayer for use with a play slide having a sloping slide surface bordered by raised sides and extending between upper and lower ends, said sprayer comprising:

a spray manifold having a generally straight portion adapted to be mounted laterally across the upper end of the slide surface and including a tubular wall internally defining a water distribution passage, said straight portion having a closed end and an opposite open end connectable with a source of pressurized water, said tubular wall including at least first and second groups of multiple spray openings, each group having individual spray openings spaced longitudinally along the straight portion of the manifold, said first group of openings being aimed to spray water generally in a first plane which, as installed, may be generally aligned with the slide surface at said upper end, said second group of openings being aimed to spray water generally in a second plane which, as installed, lies generally above the first plane and said first and second planes forming an acute angle radiating from said tubular wall.

2. A water sprayer as in claim 1 wherein said angle is in the range of from 15–45 degrees.

3. A water sprayer as in claim 1 wherein said angle is in the range of from 15–30 degrees.

4. A water sprayer as in claim 1 wherein said first and second groups of openings form, respectively, first and second vertically spaced parallel lines of openings.

5. A water sprayer as in claim 1 wherein said tubular wall is of circular cross section having a central longitudinal axis and said openings are formed on axes lying generally normal to said central axis.

6. A water sprayer for use with a play slide having a sloping slide surface bordered by raised sides and extending between upper and lower ends, said sprayer comprising:

a spray manifold having a generally straight portion adapted to be mounted laterally across the upper end of the slide surface and including a tubular wall internally defining a water distribution passage, said straight portion having a closed end and an opposite open end connectable with a source of pressurized water, said tubular wall including at least first and second groups of multiple spray openings, each group having individual spray openings spaced longitudinally along the straight portion of the manifold, said first group of openings being aimed to spray water generally in a first plane which, as installed, may be generally aligned with the slide surface at said upper end, and said second group of openings being aimed to spray water generally in a second plane which, as installed, lies generally above the first plane, said manifold including a supply portion forming a right angle with said straight portion and connecting with the open end thereof, said supply portion lying generally in said first plane parallel with the direction of aiming of said first openings.

7. A water sprayer as in claim 6 including a flow control valve in said supply portion and controlling water flow to said straight portion.

8. A water sprayer as in claim 7 wherein said valve includes a ball element having a restrictive orifice effective in an open position of the valve to limit water flow to the sprayer.

9. A water sprayer as in claim 7 including an inlet portion connecting with said supply portion and including a fitting for connecting the sprayer with a pressurized water supply.

10. A water sprayer as in claim 9 wherein said fitting connects with a standard garden hose.

11. A water sprayer in combination with a play slide having a sloping slide surface bordered by raised sides and extending between upper and lower ends, said sprayer comprising:

a spray manifold having a generally straight portion mounted laterally across the upper end of the slide surface and including a tubular wall formed of pressure resistant rigid material and internally defining a water distribution passage, said straight portion having a closed end and an opposite open end connectable with a source of pressurized water, said tubular wall including at least first and second groups of multiple spray openings, each group having individual spray openings spaced longitudinally along the straight portion of the manifold, said first group of openings being aimed to spray water generally in a first plane which is generally aligned with the slide surface at said upper end, and said second group of openings being aimed to spray water generally in a second plane extending above the first plane; said first and second planes forming an acute angle radiating from said tubular wall.

12. A combination as in claim 11 wherein said pressure resistant rigid material is a plastic.

13. A combination as in claim 12 wherein said plastic is a filled PVC.

14. A combination as in claim 11 wherein said straight portion includes a central distribution portion joining opposite end portions, the end portions being mounted to upper ends of the slide sides by clamps allowing axial sliding to accommodate thermal expansion.

15. A combination as in claim 11 wherein said manifold includes a supply portion forming a right angle with said straight portion and connecting with the open end thereof, said supply portion lying generally in said first plane parallel with the direction of aiming of said first openings and secured to one of said sides of the slide in orientation generally parallel with the upper end of the slide surface to align the first group of openings with the slide surface.

16. A combination as in claim 15 including a flow control valve in said supply portion and at least one fastener mounting said valve to said one side of the slide to secure said supply portion of the manifold to the slide.

* * * * *